US007037176B2

(12) United States Patent
Yamaguchi et al.

(10) Patent No.: US 7,037,176 B2
(45) Date of Patent: May 2, 2006

(54) THROUGH-IN GRINDING METHOD AND THROUGH-IN GRINDING APPARATUS

(75) Inventors: Yukio Yamaguchi, Kariya (JP); Mohee Sagae, Yamagata (JP)

(73) Assignees: Denso Corporation (JP); Micron Machinery Co., Ltd. (JP)

( * ) Notice: Subject to any disclaimer, the term of this patent is extended or adjusted under 35 U.S.C. 154(b) by 523 days.

(21) Appl. No.: 10/061,342

(22) Filed: Feb. 4, 2002

(65) Prior Publication Data

US 2002/0115391 A1 Aug. 22, 2002

(30) Foreign Application Priority Data

Feb. 5, 2001 (JP) ..... 2001-027643

(51) Int. Cl.
*B24B 5/18* (2006.01)

(52) U.S. Cl. ..... 451/49; 451/249

(58) Field of Classification Search ..... 451/49, 451/245, 249, 189, 241, 244, 242
See application file for complete search history.

(56) References Cited

U.S. PATENT DOCUMENTS

| | | | | |
|---|---|---|---|---|
| 1,709,818 A | * | 4/1929 | Binns | 451/242 |
| 1,924,593 A | * | 8/1933 | Binns | 451/242 |
| 4,062,150 A | * | 12/1977 | Masuda et al. | 451/72 |
| 4,083,151 A | * | 4/1978 | Jessup et al. | 451/242 |

FOREIGN PATENT DOCUMENTS

| | | | | |
|---|---|---|---|---|
| JP | 45-16870 | | 7/1970 | |
| JP | 57-48460 | * | 3/1982 | 451/242 |
| JP | 63-185557 | * | 8/1988 | 451/242 |
| JP | 04-283061 A | | 10/1992 | |
| JP | 10-151550 A | | 6/1998 | |

* cited by examiner

*Primary Examiner*—Robert A. Rose
(74) *Attorney, Agent, or Firm*—Jeffery L. Costellia; Nixon Peabody LLP

(57) ABSTRACT

In centerless grinding there are the in-feed and the through-feed scheme, each having their respective advantages and disadvantages.

When a work being machined by centerless grinding has plural portions being machined, those portions can be distinguished as portions being machined suitable for in-feed and portions being machined suitable for through-feed.

Then, the present invention, using the same centerless machine, performs through-feed grinding in the first half of the process, then automatically switches from that and performs in-feed grinding in the latter half of the process.

Thus, in a single piece of work being machined, sites suited to through-feed grinding are subjected to through-feed grinding, and sites suited to in-feed grinding are subjected to in-feed grinding. Not only so, but it is unnecessary to alter the setup between the first half of the process and the latter half of the process, wherefore centerless grinding can be performed very efficiently.

11 Claims, 9 Drawing Sheets

THROUGH-IN GRINDING METHOD AND THROUGH-IN GRINDING APPARATUS

BACKGROUND OF THE INVENTION

1. Field of the Invention

This invention relates to a centerless grinding method and centerless grinding apparatus. More particularly, the present invention relates to a new form of grinding technology created by combining the through-feed and in-feed schemes that are widely implemented in centerless technology.

2. Description of the Related Art

Centerless grinding is roughly categorized into in-feed grinding and through-feed grinding. Also implemented, to a small extent, are stationary grinding and tangential feed grinding.

FIG. 7 is a front elevation for explaining the fundamentals of centerless grinding.

Work being machined 3 is supported by a blade 1 and a regulating wheel 2 that is a revolving grinding wheel. A grinding wheel 4 that is a revolving grinding wheel makes contact with, and grinds, the work being machined 3 while revolving in the direction of the circular arc arrow $R_1$.

The work being machined 3 is turned in the direction of the circular arc arrow L by the grinding force. The regulating wheel 2 is braked by friction forces while revolving in the direction of the circular arc arrow $R_2$ at a slower circumferential speed than the grinding wheel 4, and controls the speed of revolution of the work being machined 3.

When in-feed grinding is performed, the work being machined 3 is loaded from above in the figure to the position diagrammed and, when the grinding is finished, is unloaded in the upward direction in the figure.

As the outer circumferential surface of the work being machined 3 is subjected to centerless grinding (that being in-feed centerless grinding in this case), the radial dimension of that work being machined 3 will be diminished, whereupon cutting feeding that accords with that dimension is necessary.

However, when cutting, the positional relationship between the regulating wheel 2 and the blade 1 must be held constant, wherefore an upper slide 6 whereon a regulating wheel base 5 and the blade 1 are mounted is fed in the direction of the arrow c in the figure.

As will be understood from FIG. 7, it is also possible to perform cutting feeding by moving a grinding wheel base 8 relative to a base 7 in the direction of the arrow c'.

FIG. 8 is given for explaining through-feed grinding. FIG. 8A is a diagonal view of in-feed grinding for the purpose of comparison, while FIG. 8B is a diagonal view of through-feed grinding.

Fundamentally, in the in-feed grinding diagrammed in FIG. 8A, the upper edge of the blade 1, the centerline a–a' of the work being machined 3, and the centerline b–b' of the regulating wheel 2 are mutually parallel.

In the through-feed grinding diagrammed in FIG. 8B, on the other hand, the centerline b–b' of the regulating wheel 2 is inclined at an angle θ. In FIG. 8B, the drawing of the grinding wheel is omitted, but, more precisely, the shaft of the grinding wheel and the shaft of the regulating wheel are made to incline in a twisted manner, three-dimensionally, by the angle θ, and that angle is called the feed angle.

By the action of the feed angle, a propulsion component is generated against the work being machined 3 in the direction of the arrow a' (being generated as a component of force in the a axis direction of the friction braking force). For that reason, the work being machined 3 is through-fed in the direction of the angle a' along the upper edge of the blade 1.

There are advantages and disadvantages in both in-feed grinding and through-feed grinding, respectively. Therefore, in centerless grinding technology, either in-feed or through-feed is selected after considering various work conditions such as the shape of the work being machined and the finishing precision needed.

The through-feed scheme is very convenient because the work being machined is automatically fed. Therewith, although a feed is necessary to compensate for the wear on the grinding wheel caused by long operating hours, no cutting feed is required for finishing the work being machined to the prescribed dimensions.

With the through-feed scheme of grinding, however, it is fundamentally only possible to grind a single cylindrical surface. Technology has been proposed (Japanese Utility Model Publication No. S45-16870/1970), as improved through-feed grinding, wherewith through-feed grinding is performed on a conical surface the apex angle thereof becomes smaller as a cylindrical surface is approached (called a weak conical surface). However, even with this improved through-feed grinding technology, it is only possible to grind a single weak conical surface, and end surfaces, conical surfaces, and step surfaces and the like cannot be ground.

In particular, in through-feed grinding technology, there may be a small-diameter portion that is recessed from the cylindrical surface or a weak conical surface that is the surface being machined, but there may not be any large-diameter portions that protrude from the cylindrical surface or weak conical surface.

In the prior art, the method for machining a β-alumina tube molding disclosed in Japanese Patent Application Laid-Open No. H4-283061/1992 (published) is an example of technology that makes joint use of the in-feed grinding and through-feed grinding described in the foregoing.

With the invention in that prior art, on cylindrical work being machined having portions of different thickness at one end thereof, in-feed grinding is performed in the first half of the process and through-feed grinding is performed in the latter half of the process.

Also, with through-feed grinding, the surface being machined is machined while moving in the axial direction relative to the grinding wheel and regulating wheel, wherefore grinding is done from the leading end of the work being machined. For that reason, the grinding removal amount per single revolution of the work being machined is small, the grinding resistance becomes less, and high-precision machining in a short time is possible.

With in-feed grinding, on the other hand, the entirety of the surface being machined is machined simultaneously, wherefore the grinding removal amount per single revolution of the work being machined is great, and there is a limit to how high efficiency can be raised.

FIG. 9 gives a two-perspective view of five examples of work being machined in centerless grinding.

A simple cylinder as diagrammed in FIG. 9A, or a weak cone having a small apex angle of such degree (a few degrees, for example) that it cannot be easily distinguished visually from a cylinder, is suited to through-feed grinding.

Even when there are portions of small diameter other than the surfaces being machined (indicated by the surface roughness symbols), as diagrammed in FIG. 9B, such work is suited to through-feed grinding.

When there is a portion of large diameter other than the surfaces being machined, as diagrammed in FIG. 9C, through-feed grinding cannot be done.

And, when there is a strong conical surface that is a surface being machined (indicated by the surface roughness symbols), as diagrammed in FIG. 9D, or when the end surface must be machined, as diagrammed in FIG. 9E, such work is not suited to through-feed grinding, even when there is no large-diameter portion.

Thus the cases where through-feed grinding can be applied are rather limited. Work being machined wherewith through-feed grinding is impossible is subjected to in-feed grinding.

SUMMARY OF THE INVENTION

An object of the present invention, which was devised in view of the circumstances described in the foregoing, is to provide technology that targets work being machined of such shape that conventional through-feed grinding technology cannot be applied, wherewith, after performing through-feed grinding only on cylindrical surfaces or weak conical surfaces closely approximating cylindrical surfaces, the next process step is automatically transitioned to, and an end surface, strong conical surface having a large apex angle, or step surface can be ground in a manner closely approximating in-feed grinding.

Below is given a rough description of the basic principles of the present invention, which was created to achieve the object stated above, making reference to FIG. 1 which is a plan of one embodiment thereof.

Specifically, in order to improve centerless grinding technology, and make it possible to grind work not suited to conventional through-feed centerless grinding in one process step, a feed angle is imparted to the regulating wheel 2 (which feed angle does not appear in the plan, but the end surface of that regulating wheel appears to be elliptical due to the feed angle), a cylindrical surface 10*a* and a conical surface 10*b* are formed on a grinding wheel 10, and through-feed grinding is performed in the first half of the process step while through-feeding the work being machined 9 as indicated by the arrow d. As soon as the work being machined 9 makes contact with the conical surface 10*b*, through-feed grinding is ended, the conical surface of the work being machined 9 is ground in a condition closely approximating in-feed grinding, and, together with this grinding of the conical surface of the work being machined 9, the cylindrical surface of that work being machined 9 is subjected to finishing grinding. Centerless grinding of a scheme like this, where in-feed grinding is automatically transitioned to after performing through-feed grinding initially, is called through-in grinding.

It is possible, based on the through-in grinding of the present invention described above, using a through-feed grinding scheme, first to machine the outer circumferential surface that becomes the holding reference, with high precision, in a short time, and then, while holding that machined surface as a reference, using an in-feed grinding scheme to machine a conical surface or end surface, with high precision, in a short time.

DESCRIPTION OF THE PREFERRED EMBODIMENTS

Figure 1:
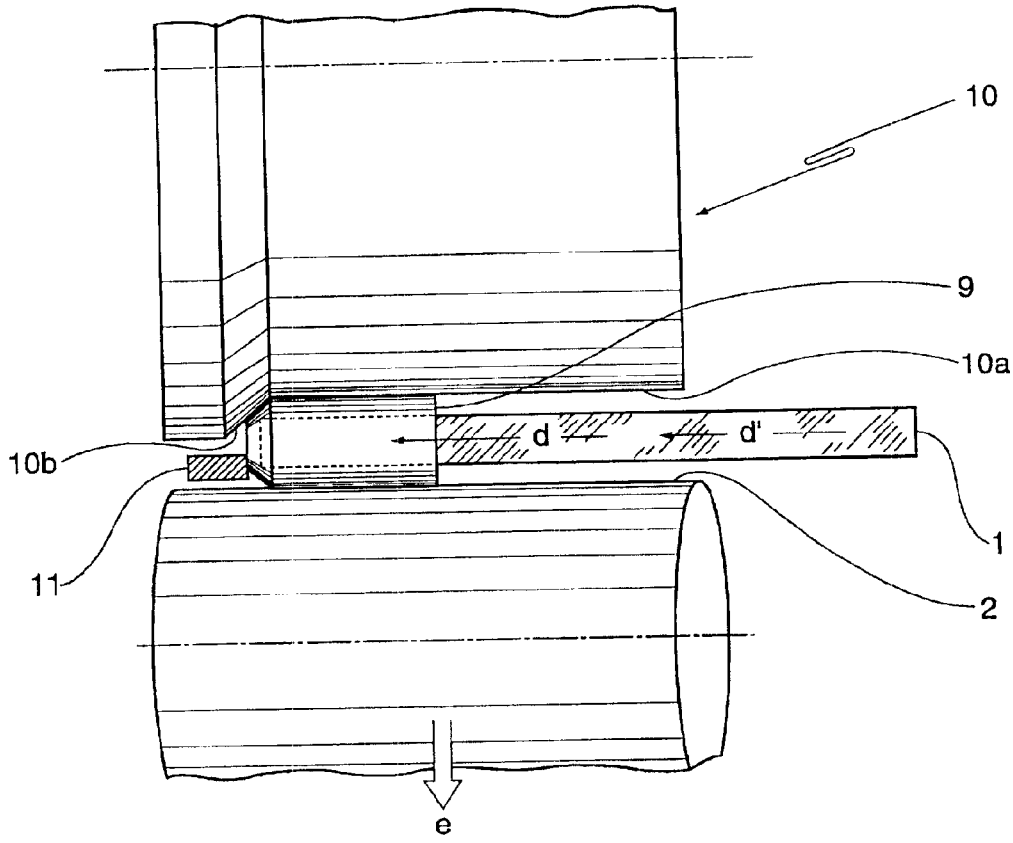
FIG. 1 is a schematic plan view representing one embodiment of the present invention.

FIG. 1 is a schematic plan view representing one embodiment of the present invention which corresponds to claims 1, 6, 7, and 8.

The grinding wheel 10 has formed therein a cylindrical surface 10*a* and a conical surface 10*b* the small-diameter end whereof is continuous with that cylindrical surface 10*a*.

The regulating wheel 2 has a feed angle imparted thereto. The means for imparting the feed angle is a vertical swing plate (not shown) of a structure that causes a regulating wheel bearing frame (not shown) that supports the regulating wheel shaft (not shown) to revolve about a horizontal axis. Considering that vertical swing plate in abstraction, it is the same as or similar to the commonly known piece of equipment provided in ordinary through-feed centerless grinders, wherefore no description is given here of the details of the structure thereof.

A feed angle is imparted, causing the regulating wheel centerline of turning to turn about a horizontal axis, wherefore the end surface of the regulating wheel 2 is projected as an elliptical shape in the plan.

The work being machined 9 is fed in as indicated by the arrow d' in the direction of the center axis thereof by conveyor means (not shown), and that work being machined 9 is mounted on the blade 1 and the regulating wheel 2, whereupon, thereafter, through-feed grinding begins as indicated by the arrow d, and the cylindrical surface of the work being machined 9 is subjected to through-feed grinding.

When the work being machined 9 makes contact with the conical surface 10*b* of the grinding wheel 10, the advance in the direction of the arrow d is stopped and through-feed grinding is stopped.

When the advance in the direction of the arrow d stops, the in-feed grinding condition ensues.

Pure in-feed grinding does not occur because the feed angle is imparted to the regulating wheel 2, but the conical surface of the work being machined 9 is subjected to centerless grinding in a condition closely approximating in-feed grinding and, during that time, the cylindrical surface of that work being machined 9 is subjected to finishing grinding while a propulsive force is being generated in the through-feed direction (arrow d). While in this quasi in-feed grinding condition, it is possible also to impart a cutting feed to the grinding wheel 10, but the desired surfaces being machined (cylindrical surface and conical surface) can be subjected to centerless grinding without imparting a cutting feed.

If a stopper 11 such as diagrammed is provided, it is possible to perform the transition from the through-feed grinding condition to the quasi in-feed grinding condition definitely, whereupon, in particular, the danger of overcutting the conical surface of the work being machined 9 is avoided.

When the quasi in-feed grinding has advanced to the desired shape and dimensions, if the regulating wheel 2 is retracted in the direction of the arrow e and separated away from the blade 1, while continuing to turn the grinding wheel 10 and the regulating wheel 2 without stopping the revolution thereof, the work being machined 9 will be pulled down by gravity and unloaded, whereupon new work being machined (not shown) can be loaded as indicated by the arrow d' right after that, and work efficiency is improved.

Figure 2:
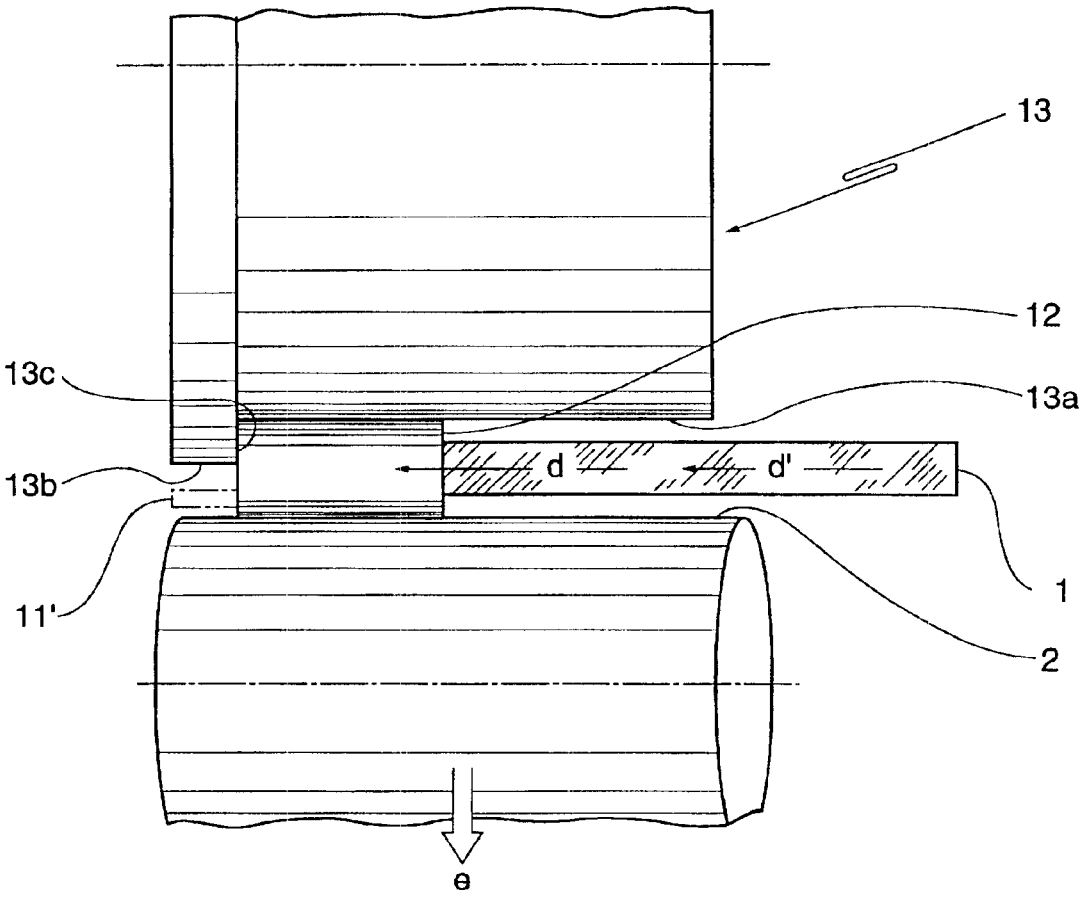
FIG. 2 is a schematic plan view in an embodiment aspect that is different from that noted above.

FIG. 2 is a schematic plan view of an embodiment that differs from that described above, and corresponds to claims 2 and 9.

What is different here from the embodiment described above (FIG. 1) is that "the surfaces being machined of the work being machined 12 are a cylindrical surface that is the surface of the side thereof, and the end surface at one end thereof."

In the grinding wheel 13 corresponding to such work being machined 12, a small-diameter portion 13*a*, a large-diameter portion 13*b*, and, between those two portions, a step surface 13*c* are formed.

The procedures of loading the work being machined 12 by conveyance means (not shown) as indicated by the arrow d', subjecting the cylindrical surface thereof to through-feed grinding while through-feeding the work being machined 12 as indicated by the arrow d, butting the work being machined 12 against the step surface 13*c* of the grinding wheel and grinding the end surface of the work being machined, and causing the work being machined 12 to drop down by gravity and unloading it are similar to those in the embodiment aspect (FIG. 1) described earlier.

In this embodiment (FIG. 2) also, the configuration is made so that, although it is possible to provide a stopper 11' as indicated by the imaginary line, when the entire surface of the end surface of the work being machined 12 is ground in a single plane, that stopper 11' is not made a fixed stationary member, but rather such that it can move forward and backward in the left and right directions, in the diagram, in a timed manner.

In the embodiment diagrammed in FIG. 2, only the cylindrical surface of the work being machined and one end surface thereof can be ground in one process step. Nevertheless, it is possible to grind both end surfaces if, in addition to repeating a similar process step two times, the work being machined is inverted between those two steps, whereupon grinding both end surfaces in that manner is within the technical scope covered by the present invention.

Figure 3A:
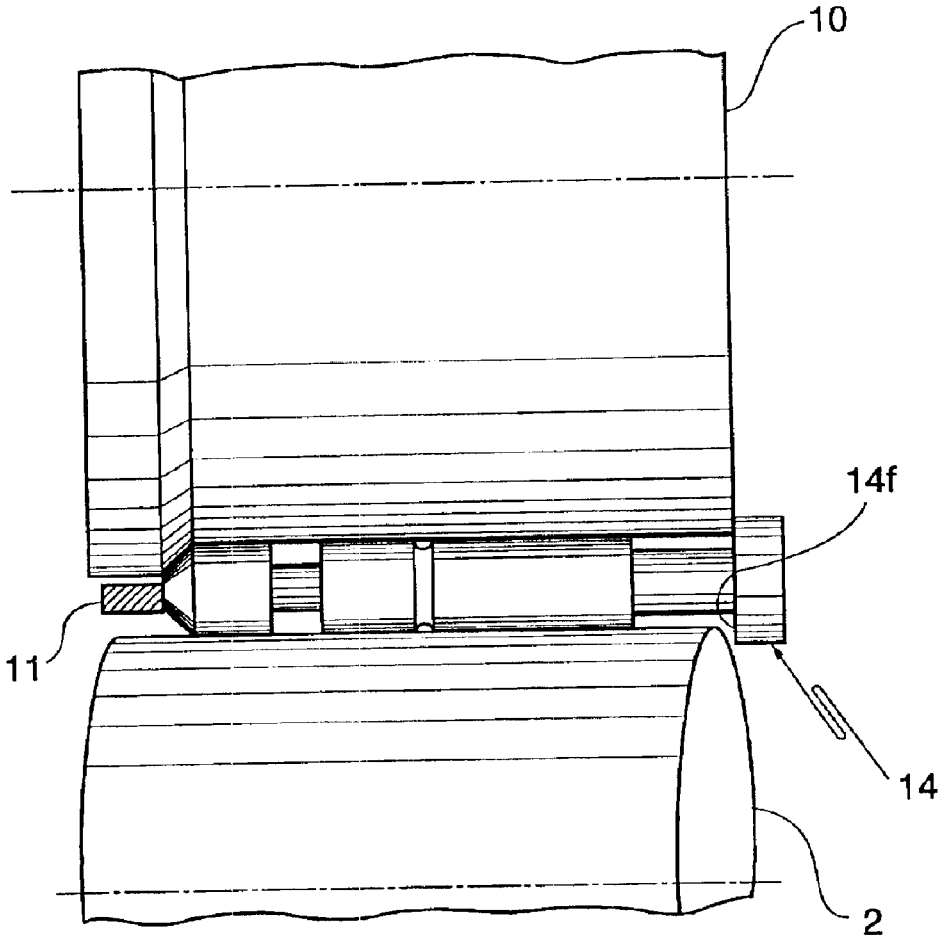
FIG. 3 represents an embodiment aspect that is different again from those noted above, 3A being a schematic plan view, and 3B being a drawing of a single piece of work being machined.
Figure 3B:
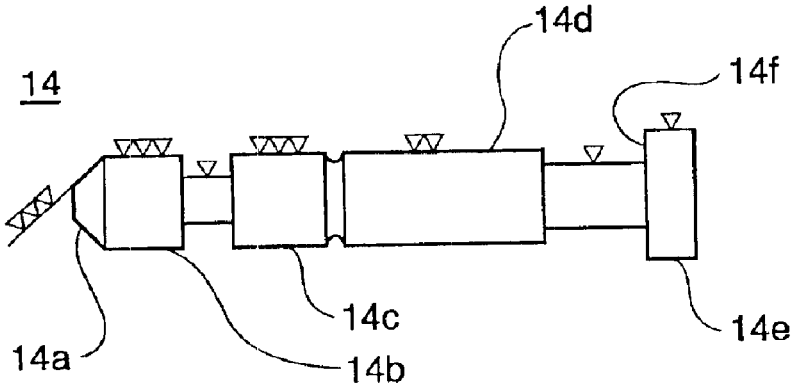

FIG. 3 represents an embodiment aspect that is different again from those noted above, with 3A being a schematic plan view, and 3B being a drawing of a single piece of work being machined.

The embodiment diagrammed in FIG. 3 is an example of a modification of the embodiment diagrammed in FIG. 1, and corresponds to claim 3. What is different from the earlier examples is as follows.

The work being machined 9 in the embodiment diagrammed in FIG. 1 has a cylindrical surface that is a surface being machined and a conical surface that is a surface being machined. Compared to this, the work being machined 14 in FIG. 3 here has a conical surface 14*a* and cylindrical surfaces 14*b* and 14*c* that are surfaces being machined requiring high precision, a cylindrical surface 14*d* for which medium precision will suffice, a cylindrical surface 14*e*, having a larger diameter than the cylindrical surfaces 14*b* and 14*c*, for which low precision will suffice, and a step surface 14*f* adjacent to the large-diameter cylindrical surface 14*e*. The surfaces being machined requiring high precision, noted above, require centerless grinding.

Providing as diagrammed in FIG. 3A, grinding is performed by the same procedures as in the embodiment (FIG. 1) described earlier. In this case, if the shape dimensions of the work being machined in the longitudinal direction and the shape dimensions of the grinding wheel 10 in the width direction are appropriately set, the step surface 14*f* can be ground simultaneously with the conical surface 14*a*.

When there is no need to grind the step surface 14*f*, it is only necessary to set the shape dimensions of the grinding wheel 10 in the width direction so that the grinding wheel 10 does not make contact with the step surface 14*f*, in a condition wherein the conical surface 14*a* of the work being machined 14 is being ground.

Figure 4A:
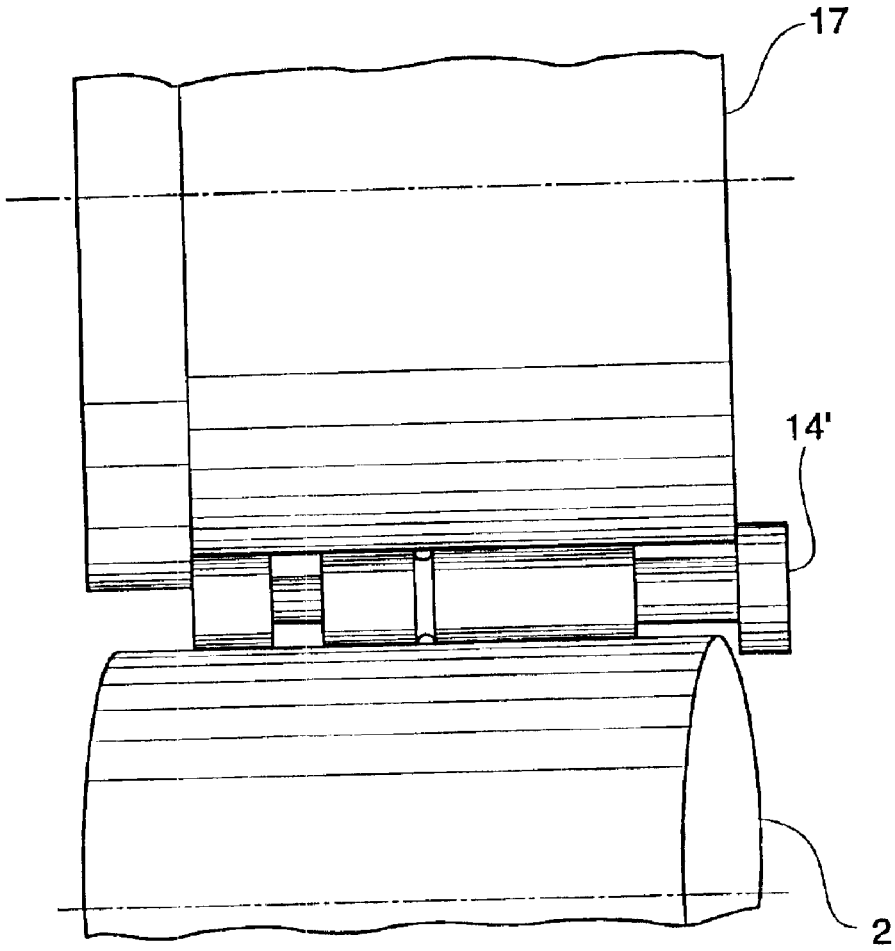
FIG. 4 represents an embodiment aspect that is different again from those noted above, 4A being a schematic plan view, and 4B being a drawing of a single piece of work being machined.

FIG. 4 represents an embodiment aspect that is different again from those noted above, with 4A being a schematic plan view, and 4B being a drawing of a single piece of work being machined.

Figure 4B:
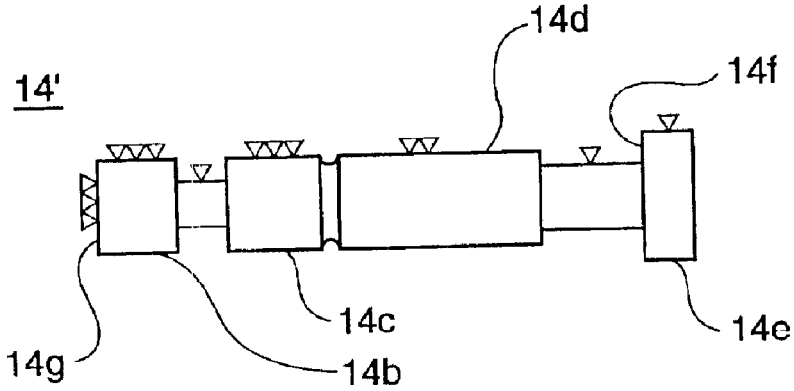

The embodiment in FIG. 4 is an example of a modification of the embodiment diagrammed in FIG. 2, and corresponds to claim 4. As diagrammed in FIG. 4B, the work being machined 14' therein has a large-diameter portion 14*e* and a step surface 14*f*.

Comparing the work being machined 14' with the work being machined 14 diagrammed in FIG. 3, the following differences are noted.

A. The work being machined 14 has the conical surface 14*a* that is a surface being machined.

B. The work being machined 14' has an end surface 14*g* that is a surface being machined.

The grinding wheel 17 is a configurational component that is similar to the grinding wheel 13 in FIG. 2 noted earlier, but the shape dimensions in the width direction thereof, in like manner as in the embodiment diagrammed in FIG. 3, noted earlier, are set so that it is possible to grind the end surface 14*g* and the step surface 14*f* of the work being machined simultaneously, or, alternatively, are set so that, when grinding the end surface 14*g*, the step surface 14*f* is not contacted.

Figure 5:
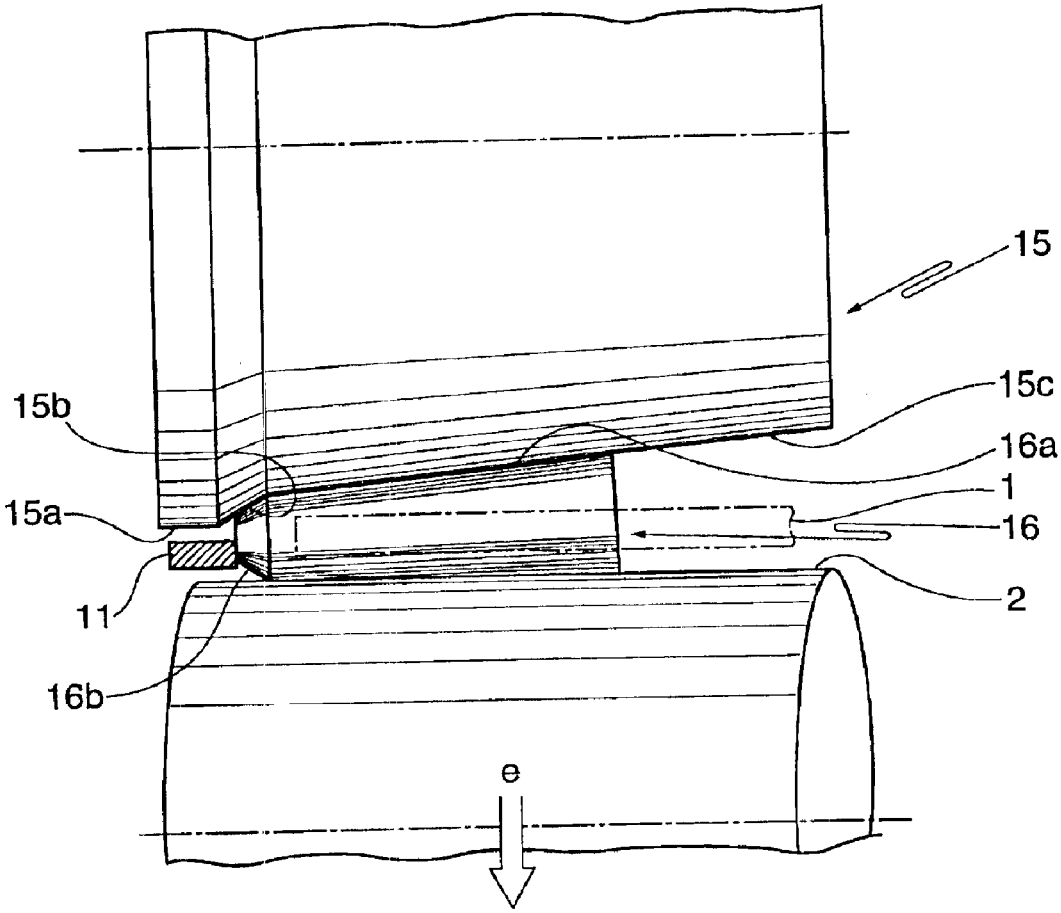
FIG. 5 is a schematic plan view representing an embodiment aspect that is different again from those noted above.

FIG. 5 is a schematic plan view representing an embodiment aspect that is different again from those noted above.

This embodiment is an example of an improvement in the embodiment diagrammed in FIG. 1, noted earlier, and corresponds to claims 5 and 10.

Compared to FIG. 1, the points of difference in FIG. 5 here are as follows.

The work being machined 9 in FIG. 1 was a cylinder having a conical surface at one end, but the work being machined 16 diagrammed in FIG. 5 is a weak conical body 16*a* having a strong conical surface 16*b* in one end.

By weak conical body, in the present invention, is meant a member having a conical surface that at first glance resembles a cylinder, having an apex angle of 5 degrees or less. In FIG. 5 here, however, the weak conical body 16*a* is depicted with an enlarged apex angle to facilitate ease of reading the drawing.

In order to make contrast with and distinguish from a weak conical surface, a conical surface having an apex angle of 20 degrees or greater is called a strong conical surface.

The grinding wheel 15 in FIG. 5 here has a strong conical portion 15*b* corresponding to (having the same apex angle as) the strong conical surface 16*b* of the work being machined 16, and a weak conical portion 15*c* corresponding to (having the same apex angle as) the weak conical surface 16*a* of the work being machined 16. Item 15*a* is a large-diameter portion.

The operating procedures in the embodiment diagrammed in FIG. 5 here are the same as in the embodiment diagrammed in FIG. 1. Thereby it is possible to perform centerless grinding on a strong conical surface and a weak conical surface in a single process step.

Figure 6:
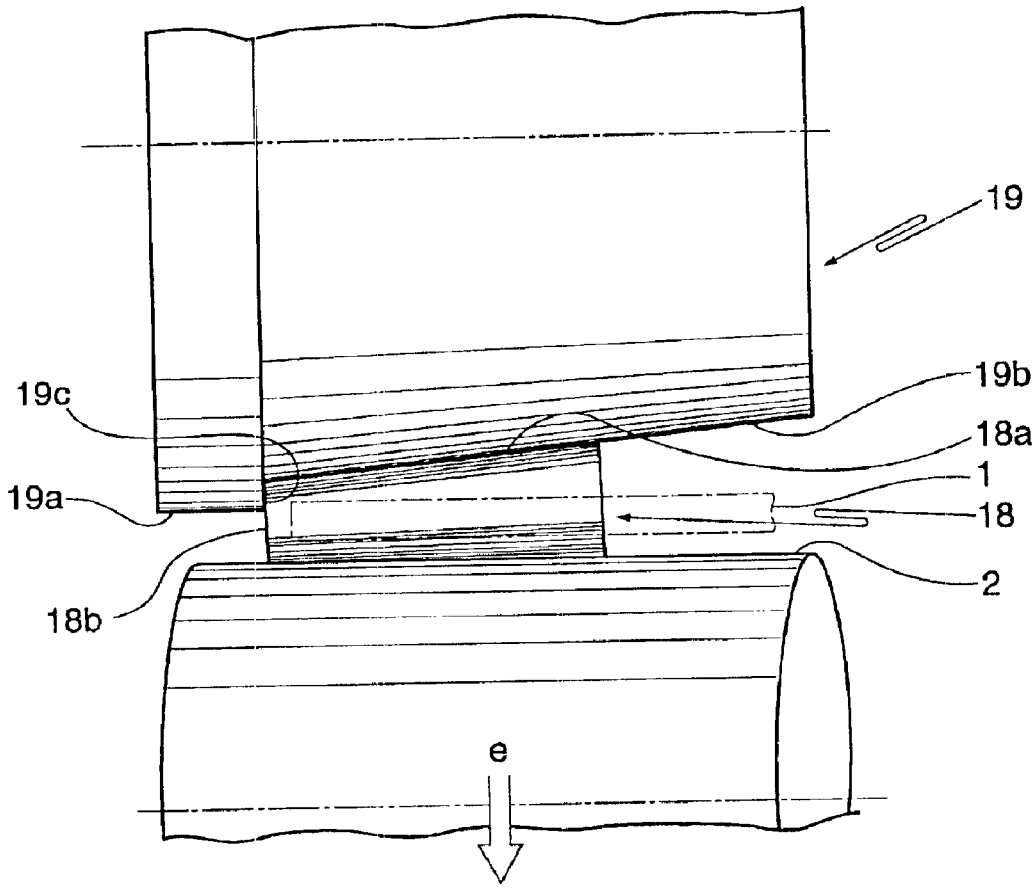
FIG. 6 is a schematic plan view representing an embodiment aspect that is different again from those noted above.
Figure 7:
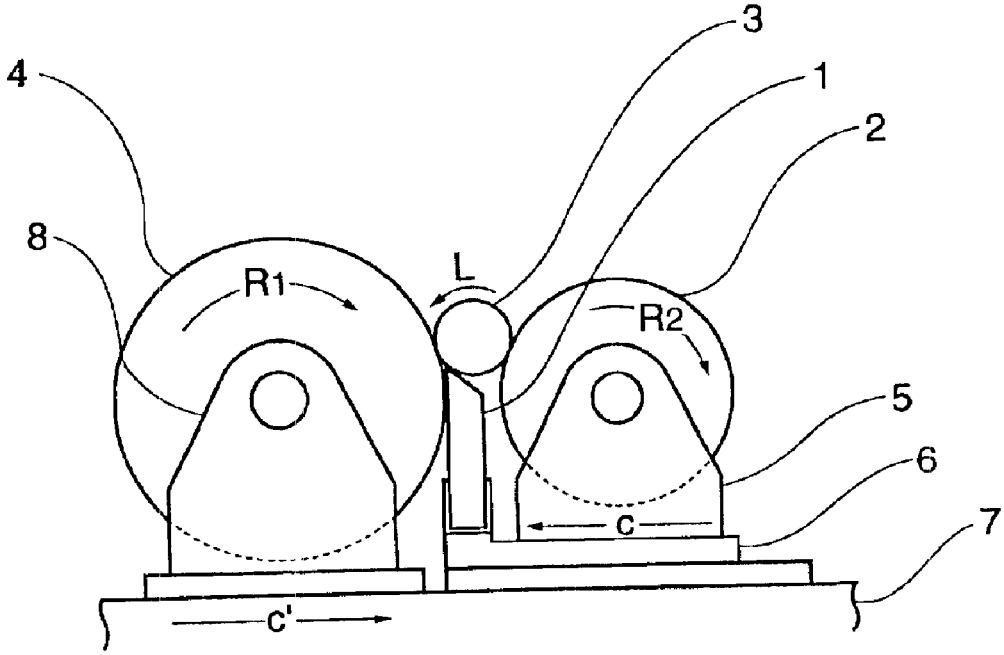
FIG. 7 is a model front elevation for explaining the fundamentals of centerless grinding technology.
Figure 8A:
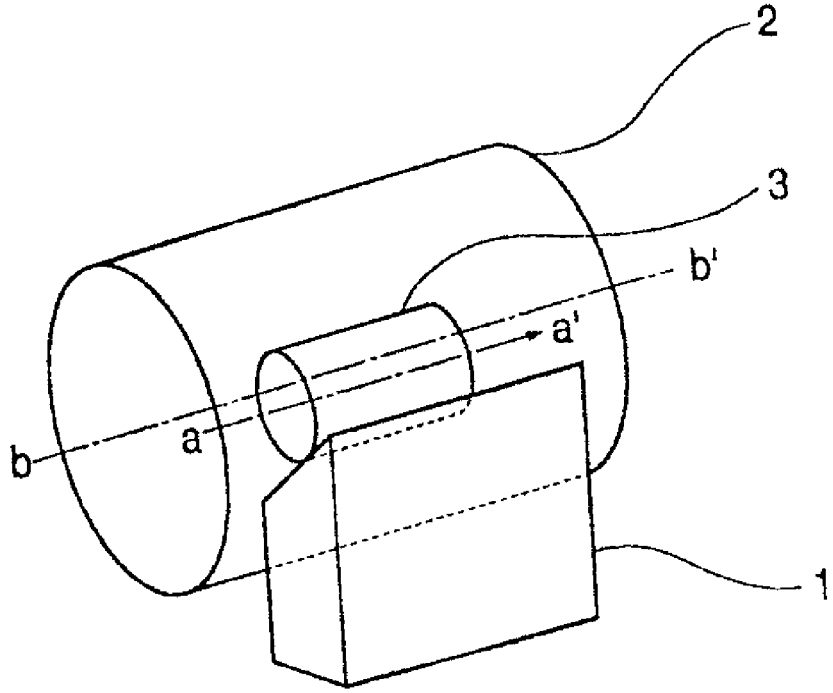
FIG. 8 is a model diagonal view given for explaining the regulating wheel feed angle, with the condition wherein in-feed grinding is being performed depicted in 8A, and the condition wherein through-feed grinding is being performed depicted in 8B.
Figure 8B:
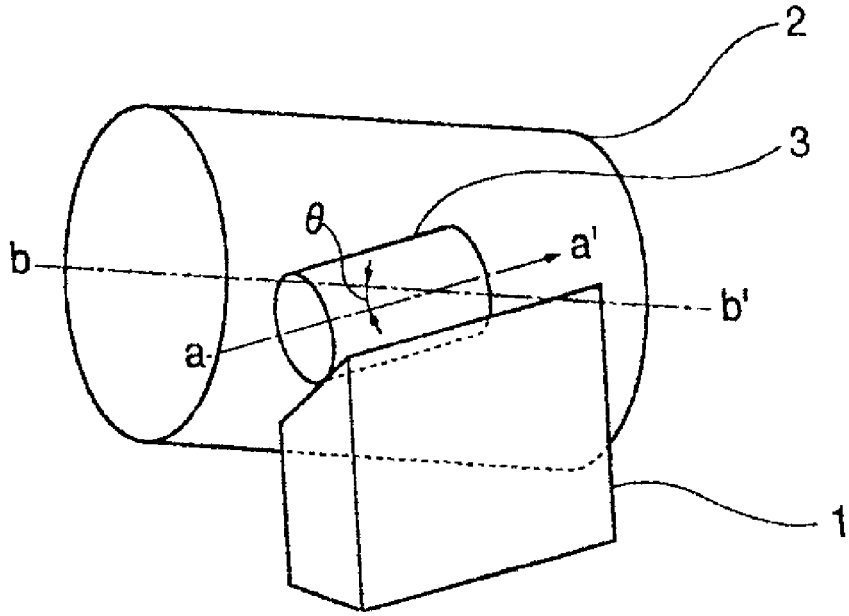
Figure 9A:
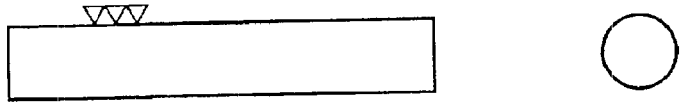
FIG. 9 provides front elevations of five examples of work being machined in centerless grinding.
Figure 9B:
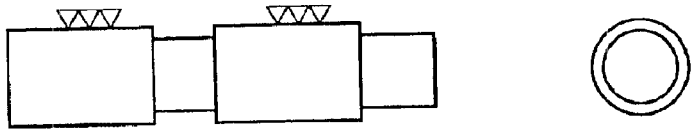
Figure 9C:
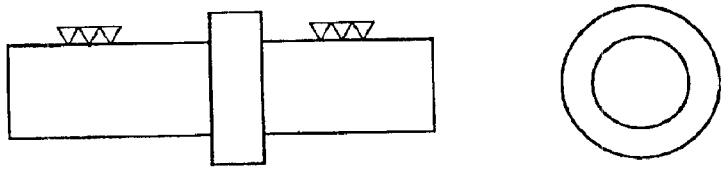
Figure 9D:
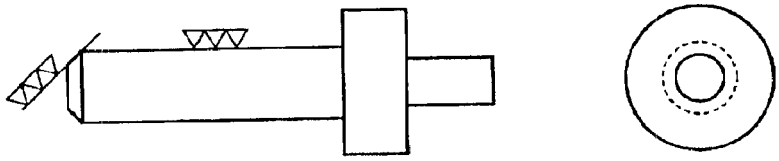
Figure 9E:
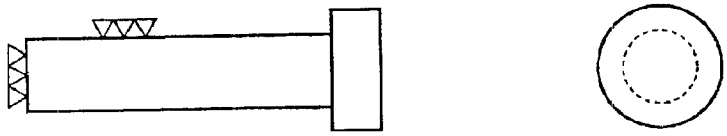

FIG. 6 is a schematic plan view representing an embodiment aspect that is different again from those noted above, and corresponds to claim 11. This embodiment is an example of a modification of the embodiment diagrammed in FIG. 2. What is different therein, compared to FIG. 2, is as follows.

A. The work being machined 12 that is diagrammed in FIG. 2 has a cylindrical surface that is a surface being machined and an end surface that is a surface being machined.

B. The work being machined 18 that is diagrammed in FIG. 6, however, has a weak conical surface 18*a* that is a surface being machined and an end surface 18*b* that is a surface being machined.

The grinding wheel 19 in this embodiment (FIG. 6) has formed therein, in correspondence with the work being machined 18 having the shape described above, a weak conical portion 19*b* having an apex angle equal to that of the weak conical surface 18*a* of the work being machined 18, and a step surface 19*c* corresponding to the end surface 18*b* of the work being machined 18.

Based on this embodiment (FIG. 6), it is possible to perform centerless grinding on a weak conical surface that is a surface being machined and the end surface on the small-diameter end thereof in a single process step.

The arrow e indicated in FIG. 5 and FIG. 6 is like the arrow e in FIG. 1 and FIG. 2, pointing to the direction wherein the regulating wheel 2 is retracted when the in-feed grinding is finished. When the regulating wheel 2 is retracted, the work being machined drops down by gravity and is unloaded.

What is claimed is:

1. A through-in grinding method for centerless-grinding a cylindrical work being machined having a conical surface at an end thereof, comprising:

supporting said work being machined by a blade and a regulating wheel to which a feed angle is imparted;

performing through-feed grinding, using a grinding wheel having cylindrical and conical surfaces, and causing the cylindrical surface of the grinding wheel to contact the cylindrical surface of said work being machined while causing said grinding wheel to revolve; and stopping through-feed grinding when the conical surface of said work being machined that was moved in the axial direction by said through-feed grinding makes contact with the conical surface of said grinding wheel, and grinding the conical and cylindrical surfaces of said work being machined in a condition closely approximating in-feed grinding, wherein, when said work being machined has been ground in a condition closely approximating in-feed grinding after being subjected to through-feed grinding, and if it is judged that said work being machined has been ground and finished to prescribed dimensions, said regulating wheel is retracted in a direction that separates same from said blade; and, by causing said work being machined to pass between said regulating wheel and said blade and drop down, the quasi in-feed grinding is terminated, and said work being machined is unloaded.

2. A through-in grinding method for centerless-grinding a cylindrical surface and one end surface of a work being machined having a cylindrical surface and an end surface, comprising:

supporting said work being machined by a blade and a regulating wheel to which a feed angle is imparted;

performing through-feed grinding, using a grinding wheel which has a large-diameter portion, a small-diameter portion, and a step surface, and causing the small-diameter portion of the grinding wheel to contact the cylindrical surface of said work being machined while causing said grinding wheel to revolve; and stopping the through-feed grinding when the end surface of said work being machined, which was moved in the axial direction by said through-feed grinding, makes contact with the step surface of said grinding wheel, and grinding the cylindrical and end surfaces of said work being machined in a condition closely approximating in-feed grinding, wherein, when said work being machined has been ground in a condition closely approximating in-feed grinding after being subjected to through-feed grinding, and if it is judged that said work being machined has been ground and finished to prescribed dimensions, said regulating wheel is retracted in a direction that separates same from said blade; and, by causing said work being machined to pass between said regulating wheel and said blade and drop down, the quasi in-feed grinding is terminated, and said work being machined is unloaded.

3. A through-in grinding method for centerless-grinding a work being machined having a cylindrical surface being machined, having a conical surface being machined at one end portion, and having a portion having a larger diameter than said cylindrical surface being machined near another other end portion, comprising:

supporting said cylindrical surface of said work being machined by a blade and a regulating wheel to which a feed angle is imparted;

performing through-feed grinding, causing the cylindrical surface of a grinding wheel having cylindrical and conical surfaces to contact said cylindrical surface of said work being machined while causing said grinding wheel to revolve; and causing the step surface of the larger-diameter portion of said work being machined to contact the end surface of said grinding wheel, and stopping through-feed grinding at approximately same time when the conical surface of said work being machined that was moved in the axial direction by said through-feed grinding makes contact with the conical surface of said grinding wheel, and grinding the conical surface and cylindrical surface, and the step surface of the larger-diameter portion of said work being machined, in a condition closely approximating in-feed grinding; or causing the conical surface of said work being machined to contact the conical surface of said grinding wheel, and stopping through-feed grinding before the step surface on the larger-diameter portion of said work being machined that was moved in the axial direction by said through-feed grinding makes contact with the end surface of said grinding wheel, and grinding the conical surface and cylindrical surface of said work being machined, in a condition closely approximating in-feed grinding, wherein, when said work being machined has been ground in a condition closely approximating in-feed grinding after being subjected to through-feed grinding, and if it is judged that said work being machined has been around and finished to prescribed dimensions, said regulating wheel is retracted in a direction that separates same from said blade; and, by causing said work being machined to pass between said regulating wheel and said blade and drop down, the quasi in-feed grinding is terminated, and said work being machined is unloaded.

4. A through-in grinding method for centerless-grinding a work being machined having a cylindrical surface, having one end surface being machined, and having a portion with a larger diameter than said cylindrical surface near another end portion being machine, comprising:

supporting said cylindrical surface of said work being machined by a blade and a regulating wheel to which a feed angle is imparted;

performing through-feed grinding, using a grinding wheel having a large-diameter portion, a small-diameter portion, and a step surface, and causing the small-diameter portion of a grinding wheel to contact the cylindrical surface of said work being machined while causing said grinding wheel to revolve; and causing the step surface of the large-diameter portion of said work being machined to contact the end surface of said grinding wheel, and stopping through-feed grinding at approximately same time when the end surface of said work being machined that was moved in the axial direction by said through-feed grinding makes contact with the step surface of said grinding wheel, and grinding the end surface, the cylindrical surface, and the step surface of the large-diameter portion of said work being machined, in a condition closely approximating in-feed grinding; or causing the end surface of said work being machined to contact the step surface of said grinding wheel, and stopping through-feed grinding before the step surface in the large-diameter portion of said work being machined that was through-fed in the axial direction by said through-feed grinding makes contact with the end surface of said grinding wheel, and grinding the end surface and cylindrical surface of said work being machined, in a condition closely approximating in-feed grinding, wherein, when said work being machined has been ground in a condition closely approximating in-feed grinding after being subjected to through-feed grinding, and if it is judged that said work being machined has been ground and finished to prescribed dimensions, said regulating wheel is retracted in a direction that separates same from said blade; and, by causing said work being machined to pass between said regulating wheel and said blade and drop down, the quasi in-feed grinding is terminated, and said work being machined is unloaded.

5. A through-in grinding method for centerless-grinding a work being machined having a weak conical surface approximating a cylindrical surface, which has a relatively small apex angle, and a strong conical surface, which has a relatively large apex angle, formed near an end on the small-diameter side of said weak conical surface, comprising:

supporting said work being machined by a blade and a regulating wheel to which a feed angle is imparted;

performing through-feed grinding, while causing a grinding wheel having a weak conical surface of small apex angle, corresponding to said weak conical surface of said work being machined, and a strong conical surface of large apex angle, corresponding to said strong conical surface of said work being machined, to revolve, causing said weak conical surface of said grinding wheel to contact said weak conical surface of said work being machined; and stopping through-feed grinding when said strong conical surface of said work being machined that was moved in the axial direction by said through-feed grinding makes contact with said strong conical surface of said grinding wheel, and grinding said strong conical surface and said weak conical surface of said work being machined in a condition closely approximating in-feed grinding.

6. The through-in grinding method according to any one of claims 1 to 4, wherein, when said work being machined is subjected to through-feed grinding and through-fed in the axial direction, a stopper is provided beforehand, movement of said work being machined in through-feed direction is stopped by causing said work being machined to abut against said stopper, through-feed grinding is thereby stopped, and a quasi in-feed grinding condition is generated.

7. The through-in grinding method according to claim 5, wherein, when said work being machined has been ground in a condition closely approximating in-feed grinding after being subjected to through-feed grinding, and if it is judged that said work being machined has been ground and finished to prescribed dimensions, said regulating wheel is retracted in a direction that separates same from said blade; and, by causing said work being machined to pass between said regulating wheel and said blade and drop down, the quasi in-feed grinding is terminated, and said work being machined is unloaded.

8. A through-in grinding apparatus comprising:

a regulating wheel supported such that a feed angle can be imparted thereto;

a grinding wheel having a cylindrical surface and a conical surface formed therein;

a blade for supporting a work being machined in cooperation with said regulating wheel;

stopping means for limiting movement, in the through-feed direction, of said work being machined and supported by said regulating wheel and said blade;

means for conveying said work being machined in the axial direction and feeding same to a position supported by said regulating wheel and said blade; and means for separating said regulating wheel from said blade and causing said work being machined to drop down by gravity and to pass between said regulating wheel and said blade, thereby unloading said work.

9. A through-in grinding apparatus comprising:

a regulating wheel supported such that a feed angle can be imparted thereto;

a grinding wheel having a large-diameter portion, a small-diameter portion, and a step surface formed therein;

a blade for supporting a work being machined in cooperation with said regulating wheel;

means for feeding said work being machined in the axial direction to a position where same is supported by said regulating wheel and said blade; and means for separating said regulating wheel from said blade and causing said work being machined to drop down by gravity and to pass between said regulating wheel and said blade, thereby unloading said work.

10. A through-in grinding apparatus comprising:

a regulating wheel supported such that a feed angle can be imparted thereto;

a grinding wheel having a weak conical portion that has a small apex angle, said weak conical portion is approximately cylindrical, and a strong conical portion that has a large apex angle;

a blade for supporting a work being machined in cooperation with said regulating wheel;

stopper means for limiting movement, in the through-feed direction, of said work being machined and supported by said regulating wheel and said blade;

means for feeding said work being machined in the axial direction to a position where same is supported by said regulating wheel and said blade; and means for separating said regulating wheel from said blade and causing said work being machined to drop down by gravity and to pass between said regulation wheel and said blade, thereby unloading said work.

11. A through-in grinding apparatus comprising:

a regulating wheel supported so that a feed angle can be imparted thereto;

a grinding wheel having a weak conical portion that has a small apex angle, which is nearly cylindrical, a large-diameter portion positioned adjacent to the end the large-diameter side of said weak conical portion, and a step surface between said large-diameter portion and the end on the large-diameter side of said weak conical portion;

a blade for supporting a work being machined in cooperation with said regulating wheel;

means for feeding said work being machined in the axial direction to a position where same is supported by said regulating wheel and said blade; and means for separating said regulating wheel from said blade and pausing said work being machined to drop down by gravity and to pass between said regulating wheel and said blade, thereby unloading said work.

* * * * *